US005368204A

United States Patent [19]

Smith

[11] Patent Number: 5,368,204

[45] Date of Patent: Nov. 29, 1994

[54] DEVICE FOR ACTUATING A DISPENSING CONTAINER MOUNTED ON A DOOR

[75] Inventor: Trevor Smith, Bedford, England

[73] Assignee: Stag Limited, Kowloon, Hong Kong

[21] Appl. No.: 990,646

[22] Filed: Dec. 14, 1992

[51] Int. Cl.[5] ..... B67D 5/06

[52] U.S. Cl. ..... 222/181; 222/182; 222/383

[58] Field of Search ..... 222/180, 181, 182, 340, 222/402.1, 402.13, 635, 383

[56] References Cited

U.S. PATENT DOCUMENTS

| | | | |
|---|---|---|---|
| 3,273,756 | 9/1966 | Levy et al. | 222/180 |
| 3,680,739 | 8/1972 | Karr | 222/180 X |
| 4,183,449 | 1/1980 | Blake | 222/340 X |
| 4,325,501 | 4/1982 | Shay | 222/340 X |
| 4,355,740 | 10/1982 | Wolf | 222/180 |
| 5,082,149 | 1/1992 | Cross | 222/180 X |

FOREIGN PATENT DOCUMENTS

| | | | |
|---|---|---|---|
| 2247721 | 3/1992 | United Kingdom | 222/180 |

*Primary Examiner*—Andres Kashnikow
*Assistant Examiner*—Joseph A. Kaufman
*Attorney, Agent, or Firm*—Dilworth & Barrese

[57] ABSTRACT

The device dispenses a dose of material, such as a perfume or deodorant, automatically on closing a door. A storage container for the material connects with a dosing compartment and an actuator releases the contents of the dosing compartment to the surroundings. A valve allows communication between the dosing compartment and the surroundings and is actuated by a holder for the container which is adapted to be fixed to the door or a jamb thereof. The holder has an arm extending radially and being hinged biasedly at a median point. A furthermost portion of the arm is adapted to contact the container or the valve to actuate the valve when the hinged portion of the arm is compressed by a gap between the door and the jamb thereof.

10 Claims, 2 Drawing Sheets

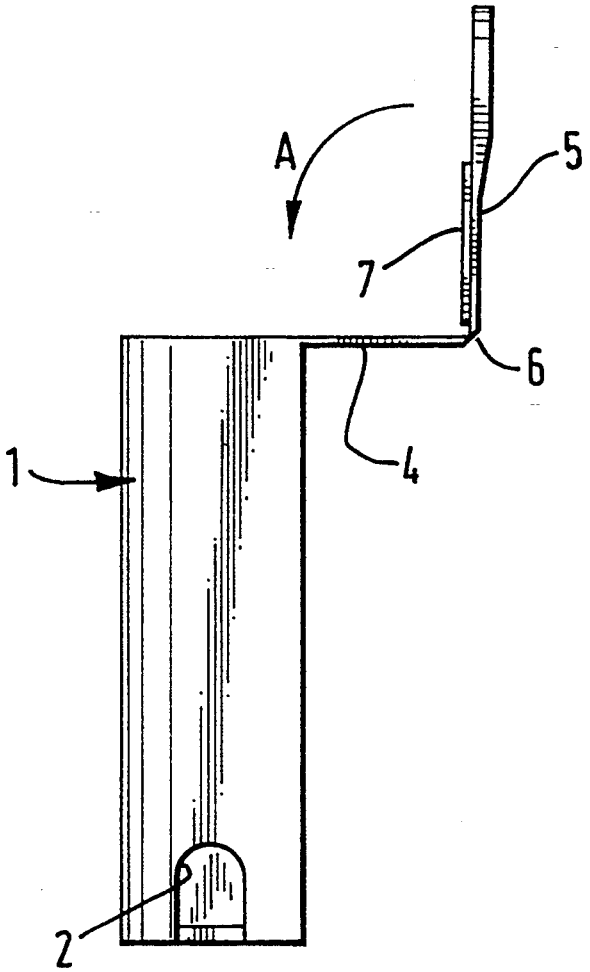
Fig. 1
Fig. 2
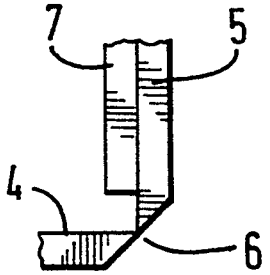
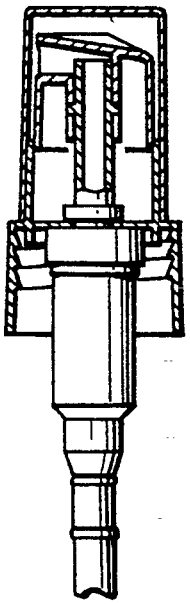
Fig. 5

DEVICE FOR ACTUATING A DISPENSING CONTAINER MOUNTED ON A DOOR

BACKGROUND OF THE INVENTION

The present invention relates to a dispensing device. More particularly, but not exclusively, it relates to a dispensing device which is adapted to be affixed in the region of a door so that a predetermined quantity of material, preferably of a fragrant or deodorising nature, is dispensed whenever the door is closed.

The present invention has particular relevance to deodorising devices for use in bathrooms and or rubbish stores, although other uses may be forseen.

It is well-known to provide hand-held aerosol cans of deodorant material or fragrant material and these are often used. However, they must be used manually and this is not always done. It is an object of the present invention to provide a device which dispenses such material automatically whenever the door of the room is closed. This frees users from the need from regular spraying and ensures that the room remains sweet-smelling.

SUMMARY OF THE INVENTION

According to the present invention, there is provided a device for dispensing a dose of material automatically on closing a door, comprising a storage container for the material, a dosing compartment, actuator means for releasing the contents of said dosing compartment to the surroundings, first valve means for closing communication between the storage container and the dosing compartment after the compartment is filled, second valve means for opening communication between the dosing compartment and the surroundings and being operable only when said first valve means is closed, actuating means to actuate said second valve means, said actuating means comprising a holder for said container adapted to be fixed to said door or a jamb thereof, an arm so extending radially from said holder and being so hinged biasedly at a median point that a furthermost portion of said arm is adapted to contact said container or said second valve means to actuate said second valve means when the hinged furthermost portion of the arm is moved against said bias in a gap between the door and the jamb thereof.

Preferably, the arm is of plastics material and the hinge comprises a portion thereof which is thinner than remaining portions of the arm.

The arm may be provided with longitudinally extending ribs, in which case the ribs on each portion of the arm co-operate to bias the hinge towards an unfolded position.

The second valve means may comprise a pump which is primed by said actuating means, in which case the pump is contacted by the arm.

Alternatively, the container may contain said material and a compressed gas, in which case the arm is adapted to contact a base of the container while the second valve means is restrained, whereby relative movement between the container and the second valve means causes the latter to open.

The holder may be provided with one or more apertures to allow egress of the material.

BRIEF DESCRIPTION OF THE DRAWINGS

Embodiments of the present invention will now be more particularly described by way of example and with reference to the accompanying drawings, in which:

FIG. 1 is a schematic side elevation of a holder for use with an aerosol can dispenser for the material;

FIG. 2 is a perspective view showing a hinge portion of an arm of the holder;

FIG. 5 is a cross-sectional view of a proprietary pump for use with a container in the invention.

DESCRIPTION OF THE PREFERRED EMBODIMENTS

Figure 3:
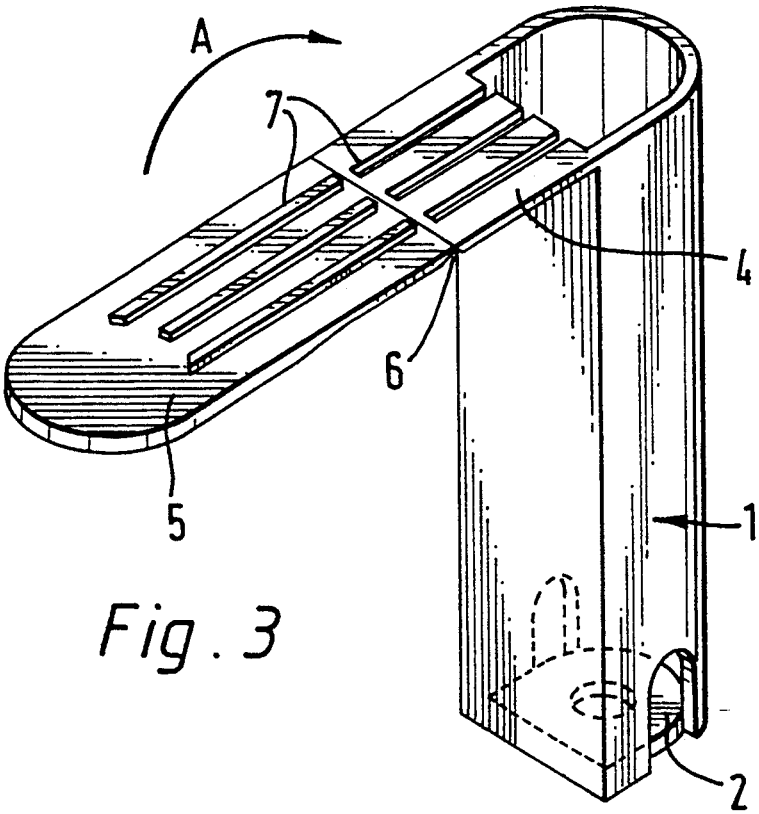
FIG. 3 is perspective view of the holder showing the FIGS. 1 and 2.
Figure 4:
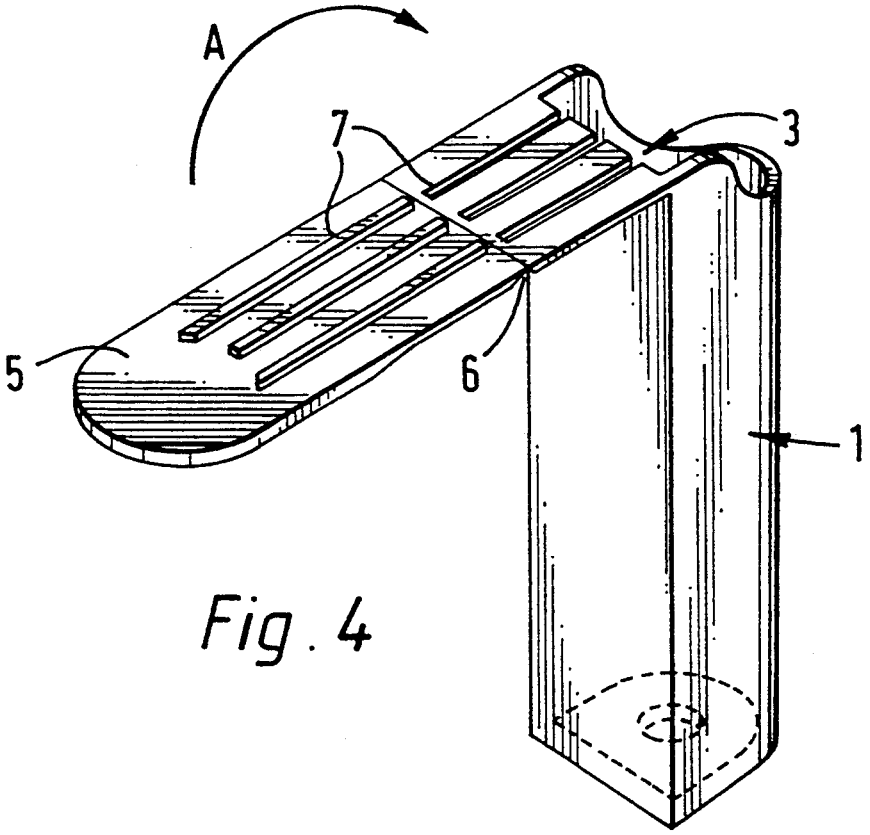
FIG. 4 shows a second embodiment of holder for use with a pump action dispensing container.

Referring now to the drawings, there is shown a holder for a device embodying the invention. The device is intended to dispense material which is preferably fragrant or deodorising, but other materials could be used. The holder 1 is dimensioned to receive either an aerosol can of e.g. air freshener or a container of material which is able to dispense the material by means of a pump action mechanism such as shown in FIG. 5.

The essential difference between the first and second embodiments of the invention is that, for use with an aerosol can, they are provided holes 2 in the holder 1 to allow egress of the material and these are disposed at a lowermost portion of the holder 1. In the case of the second embodiment, which concerns a pump action mechanism, the hole 3 is preferably disposed at an upper portion of the holder 1. The reason for this is that the actuator, to allow release of material from the container, is operated by downward pressure thereon. For reasons which will become apparent below, it is preferred that a pump action mechanism is placed so that the pump action mechanism is at the uppermost end of the container and is acted on directly by an actuator, whereas in the case of an aerosol can, it is preferred that the actuator button is held steady while pressure is applied to the can to cause relative movement therebetween.

Attached to the holder 1 extending substantially radially therefrom is an arm 4, 5, the two parts of which are hinged at point 6. This is a conventional plastics hinge, formed by a thinning of the plastics material at this point 6. The dimensions of the arms are such that arm 5, when folded back on arm 4, is able to contact either the valve of a pump action mechanism or the base of the container of aerosol.

At least the furthermost, hinged portion of the arm 5 is provided with ribs 7. These co-operate preferably with longitudinally extending slots 7 on the innermost portion of the arm and act to bias the two parts of the arm apart. In this condition, the outermost portion of the arm 5 does not contact the container and therefore the valve remains closed.

The apparatus is intended to be mounted to a door or on or adjacent to a jamb or frame thereof and to be so disposed that closing the door against the jam causes the arm portions 4 and 5 to come together against the bias, whereby the outermost portion 5 of the arm is urged into contact with either the valve or the container and thereby releases a dose of material into the surroundings.

The container contains a chamber which holds a predetermined quantity of material and this is automatically filled from the main container whenever the dosing chamber is emptied. Continued actuation of the valve does not cause excess material to be released since there is a valve between the main storage container and the dosing chamber which is only open when the exit valve is closed.

Thus, opening the door releases arm 5 from contact with the valve or container and allows the dosing chamber to be filled from the container. Closure of the door afterwards actuates the valve and allows release of the contents of the dosing chamber.

Because of the disposition of aerosol cans in the first embodiment of the invention, it is not usually possible to use conventional aerosol cans since these are provided with a dip tube which reaches down to the bottom of the can to allow the propellant to push the liquid upwardly through the tube to the valve. Aerosol cans for use in the present invention must not have such a dip tube so that the material may enter the dosing chamber directly under pressure from propellant which may be located upwardly thereof.

As may be seen from the drawings, the arm 5 rotates on the direction of arrow A when the door is closed or is closing and, while this exerts downward force on the container in the holder 1, there is also a component in a horizontal direction and this could cause problems with a standard aerosol can having a valve mechanism standing proud of the top. It has been found more efficacious to apply the pressure from the arm 5 to the base of the aerosol can, which is, overall, held steady within the holder 1.

I claim:

1. Means for actuating a device for dispensing a predetermined dose of material automatically upon closing of a door, said means comprising a holder for a container forming part of the dispensing device, said holder being structured and arranged to be mounted for co-operation with the door and a frame thereof, an arm extending laterally outwardly from said holder and being hinged with a bias at a medium point so that an outermost portion of said arm is disposed to contact and activate the dispensing device when said hinged outermost portion of said arm is moved against said bias in a gap between the door and the frame thereof, said arm being structured and arranged to contact a base of the container to actuate the dispensing device, whereby relative movement between the container and said holder therefor causes the device to dispense the predetermined dose of material.

2. Means as claimed in claim 1, wherein the arm is of plastics material and the hinge comprises a portion thereof which is thinner than remaining portions of the arm.

3. Means as claimed in claim 1, wherein a portion of the arm is provided with longitudinally extending ribs.

4. Means as claimed in claim 3, wherein a further portion of the arm is provided with longitudinally extending slots.

5. Means as claimed in claim 4, wherein the ribs act to bias the hinge towards an unfolded position.

6. Means as claimed in claim 1 wherein a lower portion of said holder is provided with at least one aperture to allow egress of the dispensed material.

7. Means as claimed in claim 1, said means being structured and arranged to effect downward pressure on the container when the door is closed.

8. Means for actuating a device for dispensing a predetermined dose of material automatically upon closing of a door, said means comprising a holder for a container forming part of the dispensing device, said holder being structured and arranged to be mounted for co-operation with the door and a frame thereof, an arm extending laterally outwardly from said holder and being hinged with a bias at a medium point that so that an outermost portion of said arm is disposed to contact and activate the dispensing device when said hinged outermost portion of said arm is moved against said bias in a gap between the door and the frame thereof, said arm being formed from plastics material and said hinged portion thereof being thinner than remaining portions of said arm, and a portion of said arm being provided with longitudinally extending ribs and a further portion of said arm being provided with longitudinally extending slots disposed to co-operate with said ribs.

9. Means as claimed in claim 8, wherein the holder is provided with at least one aperture to allow egress of the material.

10. Means as claimed in claim 8, said means being structured and arranged to effect downward pressure on the container when the door is closed.

* * * * *